US007321277B2

(12) United States Patent
Broad et al.

(10) Patent No.: US 7,321,277 B2
(45) **Date of Patent: *Jan. 22, 2008**

(54) WAVEGUIDE DIRECTIONAL FILTER

(75) Inventors: Graham J. Broad, Lilydale (AU); Noel A. McDonald, Croydon (AU); Charles Williams, Ferntree Gully (AU)

(73) Assignee: Alcatel, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/153,405

(22) Filed: Jun. 16, 2005

(65) Prior Publication Data

US 2005/0231301 A1 Oct. 20, 2005

Related U.S. Application Data

(63) Continuation of application No. 10/803,898, filed on Mar. 19, 2004, now Pat. No. 6,917,260, which is a continuation of application No. 09/857,104, filed as application No. PCT/AU99/01071 on Dec. 6, 1999, now Pat. No. 6,714,096.

(30) Foreign Application Priority Data

Dec. 4, 1998 (AU) ..... PP7470

(51) Int. Cl.
*H01P 5/00* (2006.01)

(52) U.S. Cl. ..... 333/110; 333/135; 333/21 R

(58) Field of Classification Search ..... 333/21 A, 333/21 R, 110, 135
See application file for complete search history.

(56) References Cited

U.S. PATENT DOCUMENTS

| | | | | |
|---|---|---|---|---|
| 2,423,130 | A | 7/1947 | Tyrrell | |
| 2,939,093 | A | 5/1960 | Marie | |
| 2,999,988 | A | 9/1961 | Marie | |
| 3,845,415 | A | 10/1974 | Ando | |
| 4,327,330 | A | 4/1982 | Ranghelli | |
| 4,777,459 | A | 10/1988 | Hudspeth | |
| 6,392,509 | B2 * | 5/2002 | Broad et al. | 333/212 |

OTHER PUBLICATIONS

Y. Isota et al, "Broadband Cylindrical-Cavity Directional Filter" Electronics & Communications in Japan, Part 1—Communications, NY, US, vol. 76, No. 6, Jun. 1, 1993, pp. 85-90, XP000425135.
R. C. Johnson and H. Jasik, "Antenna Engineering Handbook" 1984, NY XP002201459, pp. 42-32.

* cited by examiner

*Primary Examiner*—Dean Takaoka
(74) *Attorney, Agent, or Firm*—Sughrue Mion, PLLC

(57) ABSTRACT

A waveguide directional filter for combining multiple high power UHF television broadcasting transmitters on to a common antenna. The directional filter arrangement includes an input waveguide, an output waveguide and an interconnected cascade assembly of two or more cavity resonators. The input and output waveguides are each aperture-coupled to an end cavity resonator of the cascade assembly. The edges of each aperture incorporate inwardly extending curved protrusions of a characteristic shape. Alternatively or additionally, at least one pair of non-adjacent cavity resonators are coupled by at least one additional coupling element incorporating an external transmission line.

19 Claims, 4 Drawing Sheets

WAVEGUIDE DIRECTIONAL FILTER

This is a continuation of U.S. application Ser. No. 10/803,898 filed Mar. 19, 2004 now U.S. Pat. No. 6,917,260, which is a continuation of U.S. application Ser. No. 09/857,104 filed Sept. 18, 2001, now U.S. Pat. No. 6,714,096, which was a national stage entry of PCT/AU99/01071 filed Dec. 6, 1999 having a 35 U.S.C. 371 acceptance date of Sep. 18, 2001, the disclosures of all of which are incorporated herein by reference.

FIELD OF THE INVENTION

This invention relates to the technology of combining multiple UHF TV broadcasting transmitters on to a common antenna.

BACKGROUND OF INVENTION

In this technology it is known to provide a UHF filter/combiner system comprising an assembly of dual bandpass filters whose inputs and outputs are coupled by waveguide hybrid couplers. A disadvantage of this known system is its relatively large size. Another disadvantage of this system is that the dual bandpass filters must be electrically identical, which is difficult to accomplish due to their complexity.

It is also known to provide a UHF filter/combiner that comprises a cascade of dual mode resonant cavities with input and output coaxial coupling elements, such as the "ROTAMODE" device. However, a disadvantage of this form of construction is that the power handling capability of the coaxial input and output elements is limited.

It is also known to use a waveguide directional filter technique at microwave multi-point distribution system (MMDS) frequencies above 2 GHz. Each TV channel at MMDS frequencies occupies a fractional bandwidth of much less than 1%. However, at UHF broadcasting frequencies in the range 470-860 MHz, the fractional bandwidth of a TV channel is of the order of 1% or more, and a conventional waveguide directional filter does not provide a satisfactory electrical performance.

SUMMARY OF THE INVENTION

It is an object of the present invention to provide a waveguide directional filter arrangement which can be used at UHF broadcasting frequencies, and avoids the disadvantages of the aforementioned prior art.

According to a first aspect of the invention there is provided a waveguide directional filter arrangement comprising an input waveguide, an output waveguide and an interconnected cascade assembly of two or more cavity resonators, wherein said input waveguide and said output waveguide each include broad wall sections joined by narrow wall sections whose aspect ratio is greater than 2:1.

According to a second aspect of the invention there is provided such a waveguide directional filter arrangement wherein each said waveguide is coupled via an aperture to an end cavity resonator of said cascade assembly, wherein edges of each aperture include inwardly extending curved protrusions of approximately hemicycle-shaped form.

According to a third aspect of the invention there is provided a waveguide directional filter arrangement comprising an input waveguide, an output waveguide and an interconnected cascade assembly of at least three stacked resonator elements, wherein said input waveguide and said output waveguide each include broad wall sections joined by narrow wall sections whose aspect ratio is greater than 2:1, each said waveguide coupled via an aperture to an end resonator of the cascade assembly, wherein at least one pair of non-adjacent cavity resonators are coupled by at least one additional coupling element incorporating an external transmission line.

BRIEF DESCRIPTION OF THE DRAWINGS

The invention will be more clearly understood from the following detailed description in conjunction with the accompanying drawings, in which.

DETAILED DESCRIPTION OF THE INVENTION

Figure 1:
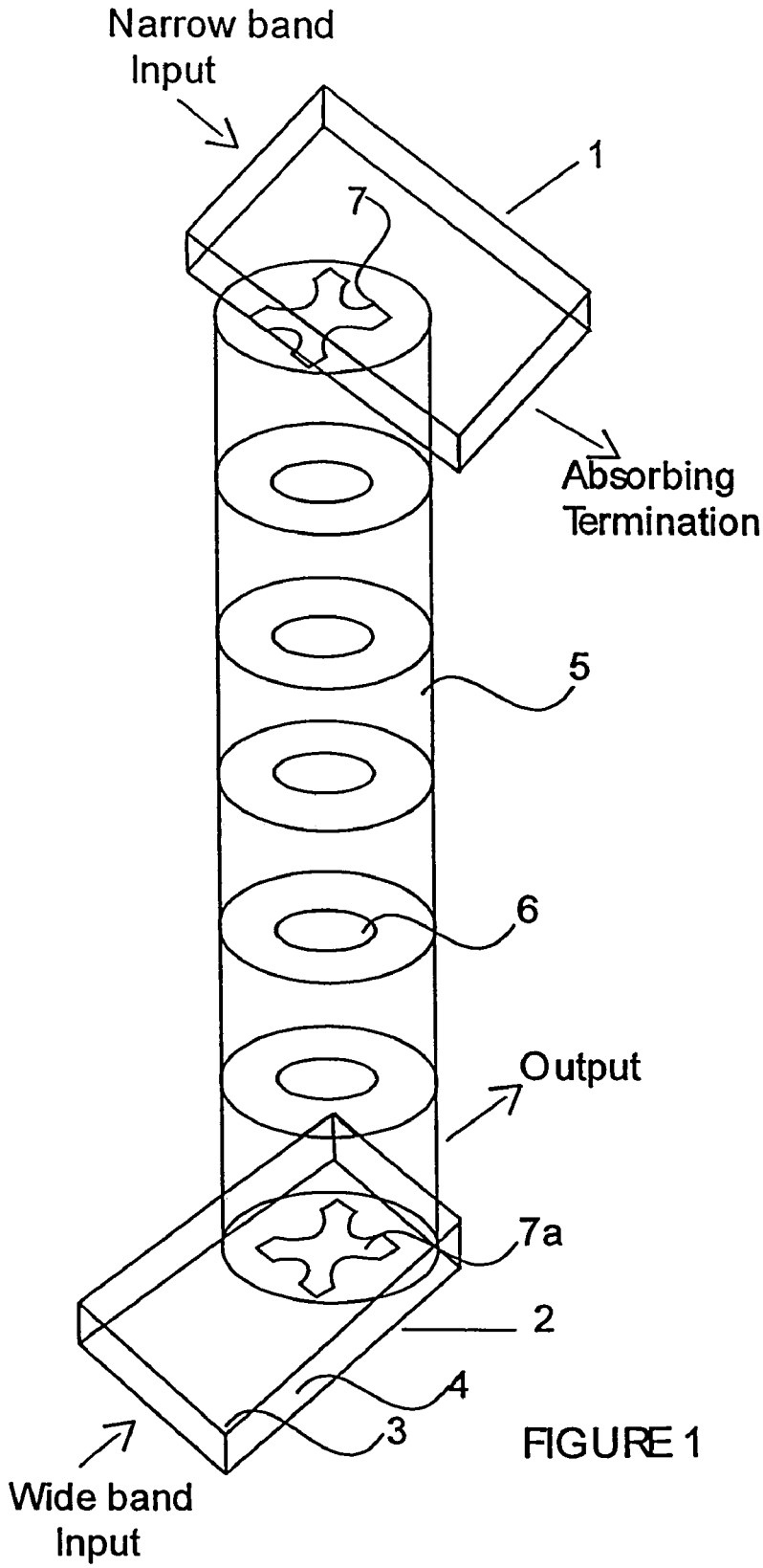
FIG. 1 shows a waveguide directional filter assembly of the present invention.

Referring to FIG. 1, the assembly comprises an input waveguide 1 having a narrow band input port and an absorbing termination port; and an output waveguide 2 having a wideband input port and an output port. The waveguides are rectangular having broad walls 3 joined to narrow walls 4 whose aspect ratio is approximately 4:1.

Waveguides 1 and 2 are connected by six circularly cylindrical aperture coupled cavity resonators 5. Direct coupling between adjacent cavity resonators is provided by circular apertures 6.

Figure 2:
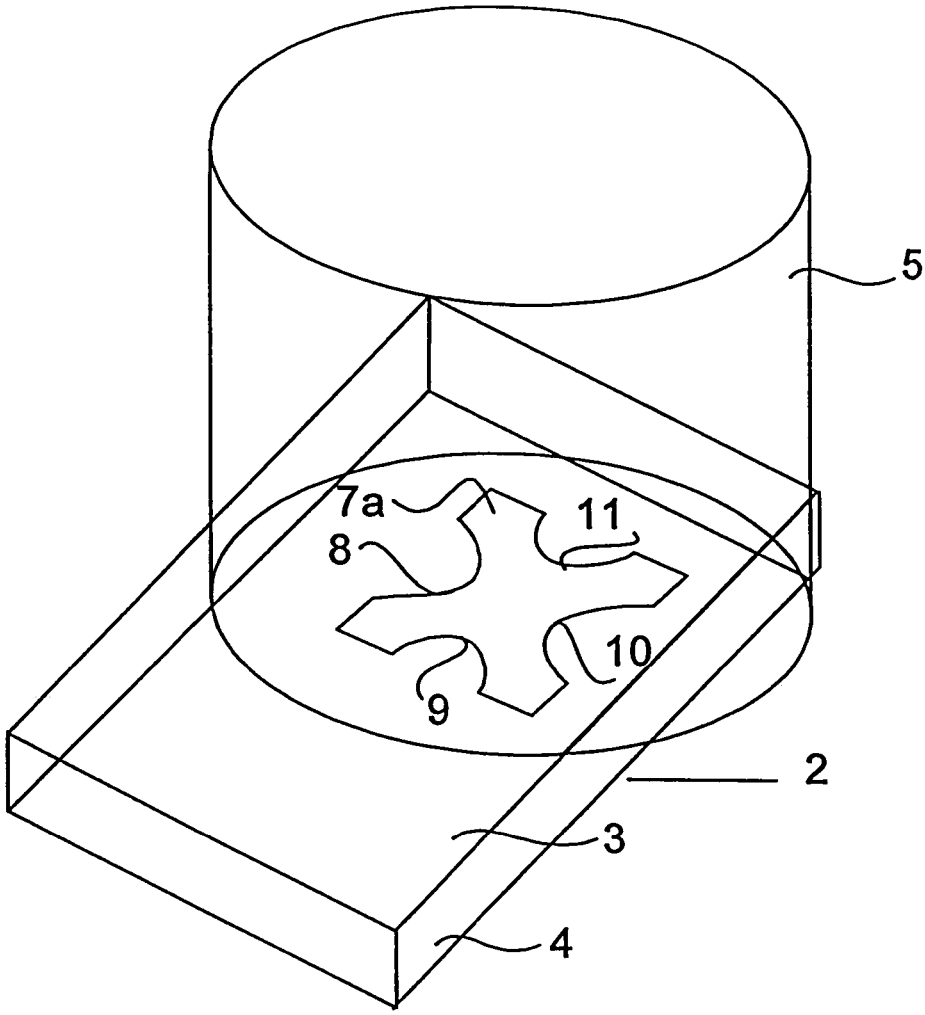
FIG. 2 shows a more detailed view of the aperture arrangement of the assembly shown in FIG. 1.

Each end cavity resonator is operatively coupled to its associated rectangular waveguide by a characteristically shaped aperture 7, 7*a*. Referring to FIG. 2, aperture 7*a*, which is similar to aperture 7 in input waveguide 1, is in the form of a rectangle whose four sides have integral inwardly extending curved protrusions 8, 9, 10 and 11 of hemicycle shape. These hemicycle protrusions significantly influence the electromagnetic coupling from the waveguide into the adjacent cavity resonator.

It will be understood that the inwardly extending hemicycle protrusions can be in the form of discrete elements, such as for example discs, that can be attached around the edges of a basic rectangular aperture. The position of such discrete elements can be made adjustable to vary the coupling through the aperture.

Figure 3:
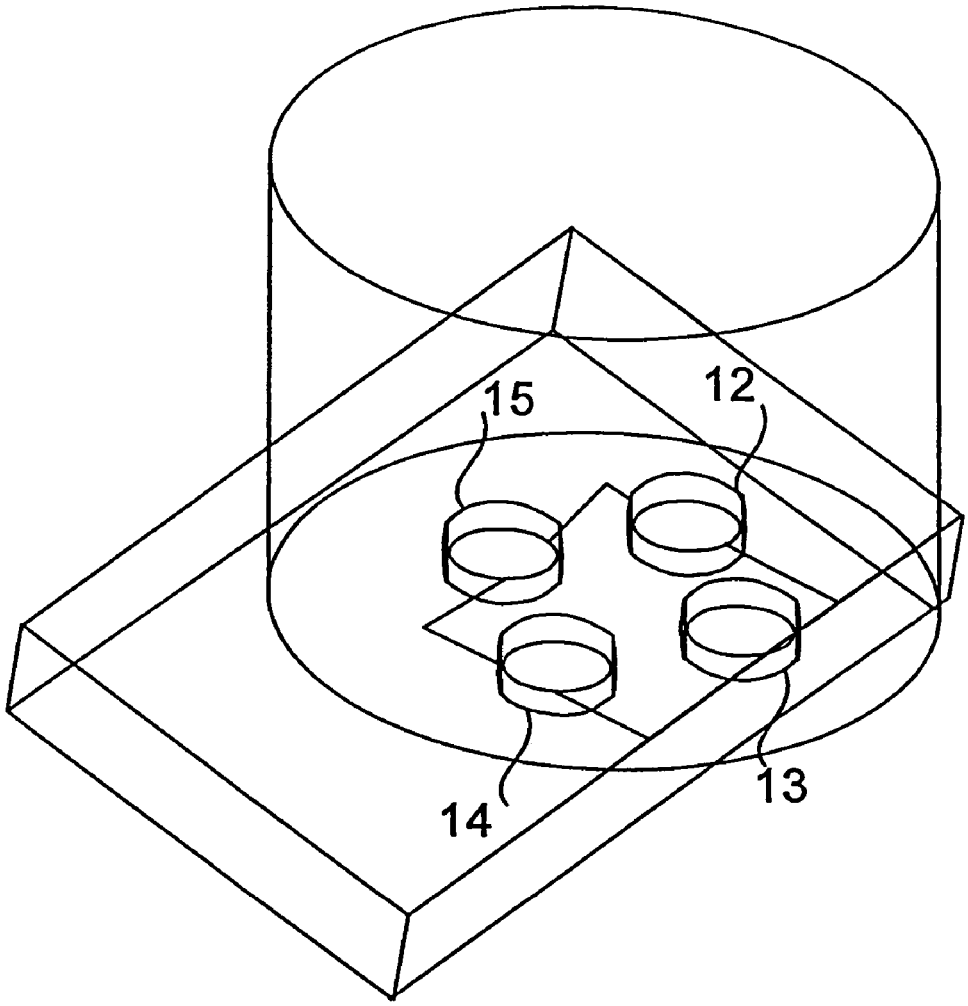
FIG. 3 shows an alternative aperture arrangement.

Alternatively, the inwardly extending hemicycle protrusions can be in the form of cylinders 12, 13, 14 and 15 as shown in FIG. 3. As with the above mentioned discs, the positions of the cylinders can be adjustable to vary the coupling through the aperture. Moreover, a cylindrical form of significant height reduces the electromagnetic coupling of undesirable cavity resonator modes.

Figure 4:
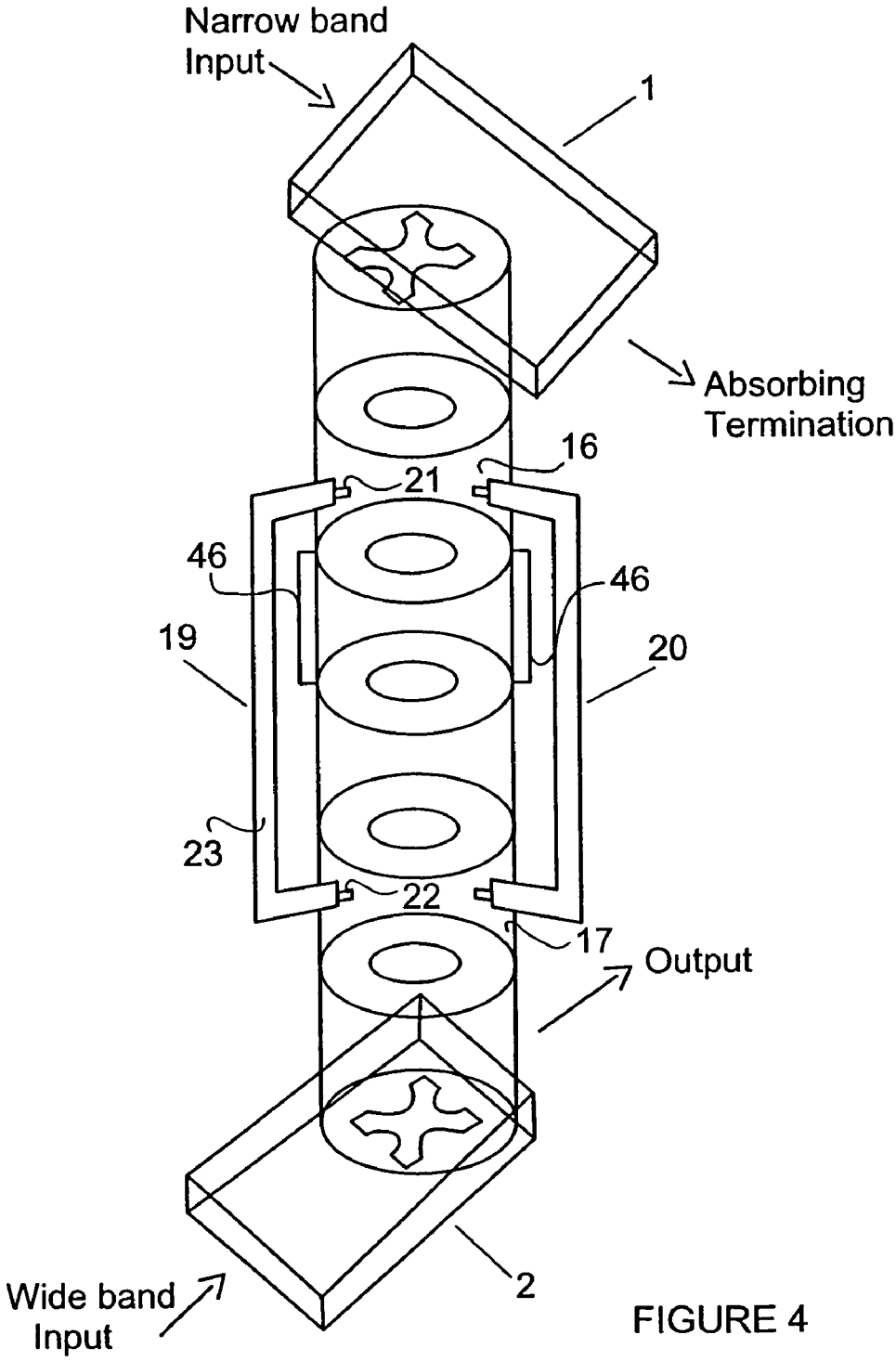
FIG. 4 shows a waveguide direction filter assembly with additional coupling between non-adjacent resonators.

Referring to FIG. 4, non-adjacent cavity resonators 16 and 17 of the waveguide directional filter assembly are provided with two additional coupling elements 19 and 20. Each additional coupling element comprises two probes 21 and 22 connected by a transmission line 23. The probes extend into the resonators and are disposed at 90° to one another.

The power handling capability of the waveguide directional filter arrangement described above can be enhanced by the addition of cooling fins 46 on one or more of the cavity resonators.

Also, tuning elements (not shown) can be added to the cavity resonators.

In operation, a narrow band signal is injected into the input port of input waveguide 1. This signal is coupled through aperture 7 into the first cavity resonator and launches a circularly polarised wave therein which is coupled through successive circularly cylindrical resonators 5 by means of circular apertures 6 to the output waveguide 2 via aperture 7*a*, where it produces a directional wave. This signal is added to any existing signals travelling through the same waveguide at other frequencies.

An absorbing termination coupled to waveguide 1 absorbs any power not coupled into the first resonator.

An advantage of the waveguide directional filter assembly of the present invention vis-a-vis the prior art assembly using separate hybrids and filters is that the assembly of the present invention is relatively unaffected by temperature differentials which can occur between separate filters in a hybrid coupled configuration. Such temperature differentials lead to a degradation of performance.

What is claimed is:

1. A waveguide directional filter arrangement comprising an input waveguide, an output waveguide and a resonator structure comprising at least one cavity resonator, wherein each said waveguide is coupled via a respective aperture to said resonator structure, wherein each aperture includes a plurality of inwardly extending curved protrusions of approximately hemicycle shape, each protrusion comprising a curved segment having and edge with a continuous radius of curvature along which there are two intermediate points at each of which a tangent to said edge is parallel to a tangent to an edge of a different one of said protrusions.

2. A waveguide directional filter arrangement as claimed in claim 1, wherein said approximately hemicycle-shaped curved protrusions are integral with said aperture.

3. A waveguide directional filter arrangement comprising an input waveguide, an output waveguide and a resonator structure comprising at least one cavity resonator, wherein each said waveguide is coupled via a respective aperture to said resonator structure, wherein each aperture includes a plurality of inwardly extending curved protrusions of approximately hemicycle shape, wherein said protrusions are in the form of portions of cylinders.

4. A waveguide directional filter arrangement comprising an input waveguide, an output waveguide and a resonator structure comprising at least one cavity resonator, wherein each said waveguide is coupled via a respective aperture to said resonator structure, wherein each aperture includes a plurality of inwardly extending curved protrusions of approximately hemicycle shape, wherein said approximately hemicycle-shaped curved protrusions are integral with said aperture, and wherein said protrusions are in the form of portions of cylinders.

5. A waveguide directional filter arrangement comprising an input waveguide, an output waveguide and a resonator structure comprising at least one cavity resonator, wherein each said waveguide is coupled via a respective aperture to said resonator structure, wherein each aperture includes a plurality of inwardly extending curved protrusions of approximately hemicycle shape, wherein said approximately hemicycle-shaped curved protrusions are in the form of discrete members attached proximate said edges of said aperture.

6. A waveguide directional filter arrangement as claimed in claim 5, wherein said approximately hemicycle-shaped curved protrusions have an associated adjustment mechanism for positional adjustment of the protrusions.

7. A waveguide directional filter arrangement as claimed in claim 5, wherein said protrusions are in the form of portions of cylinders.

8. A waveguide directional filter arrangement as claimed in claim 6, wherein said protrusions are in the form of portions of cylinders.

9. A waveguide directional filter arrangement including an input waveguide, an output waveguide and an interconnected cascade assembly of three or more cavity resonators, wherein each said waveguide is coupled via an aperture to said assembly, wherein at least one pair of non-adjacent cavity resonators are coupled by at least one additional coupling element.

10. A waveguide directional filter arrangement as claimed in claim 9, wherein the at least one additional coupling element extends into each cavity resonator of the non-adjacent pair of cavity resonators.

11. A waveguide directional filter arrangement as claimed in claim 9, wherein the at least one pair of non-adjacent cavity resonators are coupled by two additional coupling elements incorporating external transmission lines, the two additional coupling elements being disposed in a pre-determined space relationship of approximately 90° to each other.

12. A waveguide directional filter arrangement as claimed in claim 10, wherein the at least one pair of non-adjacent cavity resonators are coupled by two additional coupling elements incorporating external transmission lines, the two additional coupling elements being disposed in a pre-determined space relationship of approximately 90° to each other.

13. A waveguide directional filter arrangement comprising an input waveguide, an output waveguide and a resonator structure comprising at least one cavity resonator, wherein at least one of said waveguides is coupled via an aperture to said resonator structure, wherein said aperture includes a plurality of inwardly extending curved protrusions of approximately hemicycle shape, each protrusion comprising a curved segment with an edge having a continuous radius of curvature along which there are two intermediate points at each of which a tangent to said segment is parallel to a tangent of a different one of said protrusions.

14. A microwave filter comprising a housing containing a plurality of cavity resonators coupled to one another via an aperture coupling arrangement in a common wall, said aperture coupling arrangement comprising an aperture having at least one slit provided with a moveable metal slug that is slideably retained by opposite longitudinal edges of the slit, and a position adjustment mechanism accessible from outside of said housing to permit adjustment of the position of said metal slug.

15. A microwave filter according to claim 14, wherein said aperture coupling arrangement includes four slits each including a said slug.

16. A waveguide directional filter arrangement comprising an input waveguide, an output waveguide and a resonator structure comprising at least one cavity resonator, wherein at least one of said waveguides is coupled via an aperture to said resonator structure, wherein said aperture includes a plurality of curved protrusions extending inwardly toward the center of said aperture, each protrusion comprising a curved segment having an edge with a continuous radius of curvature along which there are two intermediate points at each of which a tangent to said segment is parallel to a tangent of a different one of said protrusions.

17. A waveguide directional filter according to claim 16, wherein said edge of each said projection has a continuous curvature.

18. A waveguide directional filter according to claim 16, wherein said protrusions result in an aperture opening comprising a plurality of radially extending segments, with opposed surfaces of each segment not parallel to one another.

19. A waveguide directional filter according to claim 16, wherein the collective surface area of said protrusions is less than an open area of said aperture.

* * * * *